US006755172B2

(12) United States Patent
Neubock et al.

(10) Patent No.: US 6,755,172 B2
(45) Date of Patent: Jun. 29, 2004

(54) THRUST STOPPER DEVICE FOR CAMSHAFT

(75) Inventors: Johann Neubock, Gunskirchen (AT); Siegfried Heer, Kirchdorf (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 10/173,556

(22) Filed: Jun. 18, 2002

(65) Prior Publication Data

US 2003/0177998 A1 Sep. 25, 2003

Related U.S. Application Data

(60) Provisional application No. 60/366,540, filed on Mar. 25, 2002, and provisional application No. 60/382,365, filed on May 23, 2002.

(51) Int. Cl.[7] ..... F01L 1/04

(52) U.S. Cl. ..... 123/193.5; 123/90.27

(58) Field of Search ..... 123/193.5, 90.27

(56) References Cited

U.S. PATENT DOCUMENTS 5,617,818 A * 4/1997 Luders ..... 123/193.5
6,390,863 B1 * 5/2002 Imanaga ..... 440/53

FOREIGN PATENT DOCUMENTS

AT 003 202 U1 3/1998
JP 09-144512 6/1997

* cited by examiner

*Primary Examiner*—Marguerite McMahon
(74) *Attorney, Agent, or Firm*—BRP-Legal Services

(57) ABSTRACT

A thrust stopper for use in a cylinder head arrangement of an internal combustion engine to retain a camshaft in a desired orientation while prevent axial movement and clatter is disclosed.

43 Claims, 9 Drawing Sheets

THRUST STOPPER DEVICE FOR CAMSHAFT

CROSS REFERENCE TO RELATED APPLICATIONS

This application relates to and claims priority on U.S. Provisional Patent Application No. 60/366,540, filed on Mar. 25, 2002 and U.S. Provisional Application No. 60/382,365, filed on May 23, 2002, which are incorporated herein by reference.

BACKGROUND OF THE INVENTION

1. Field of the Invention

The present invention relates to a thrust stopper for a camshaft in a cylinder head arrangement for an internal combustion engine. In particular, the present invention is directed to a thrust stopper that is fixed within the cylinder head arrangement to secure a camshaft within the cylinder head housing against axial movement and lateral movement. The thrust stopper in accordance with the present invention ensures that the valve operating assembly is positioned correctly within the cylinder head arrangement.

2. Description of Related Art

JP 09-144 512 A describes a cylinder head with a camshaft and a rocker arm shaft to actuate inlet and exhaust valves, in which the camshaft is secured in the axial direction by two thrust stoppers. Each thrust stopper functions as an axial stop for the camshaft in one direction. The thrust stoppers, which are in the form of sheet metal parts, are secured to the cylinder head arrangement using bolts. This thrust stopper requires multiple installation steps and the use of fasteners, which increases costs and assembly time.

A similar method for securing the camshaft has been used by the assignee of the present invention in scooter motors for a number of years. In this instance, the thrust stopper is also of sheet metal and is secured using bolts to one end face of the cylinder head. In contrast to JP 09-144 512 A, however, the sheet metal part engages in a slot-like recess in the camshaft, and this ensures axial retention in both directions. Thus, only one thrust stopper is required. The slot-like recess or groove is positioned between a camshaft drive assembly and the cam lobes and thus reduces the cross section of the camshaft, which could weaken the camshaft.

Austrian Reference No. AT 3.202 U1 describes a cylinder head with a camshaft and a rocker arm shaft. A positioning device is provided to ensure that the rocker arm shaft is positioned correctly. The positioning device includes a plug that is fixed in a receiving opening in the rocker arm shaft. The plug has a projection formed as a ridge that fits in a groove in the end of the rocker arm shaft. This ensures the rapid and correct positioning of the rocker arm shaft, although the rocker arm shaft can be installed in two positions that are rotated through 180 degrees relative to each other. This positioning device, however, is inadequate for rocker arm shafts that can be used only in one single position.

OBJECTS OF THE INVENTION

It is an object of the present invention to provide a thrust stopper for securing a camshaft in a proper orientation within a cylinder head arrangement within an internal combustion engine.

It is another object of the present invention to provide a thrust stopper that prevents axial movement of the camshaft within the cylinder head arrangement.

It is another object of the present invention to provide a thrust stopper for securing the camshaft within the cylinder head arrangement using limited parts and reduced assembly time.

It is another object of the present invention to provide a thrust stopper for securing a valve operating assembly in a proper orientation within the cylinder head arrangement.

It is another object of the present invention to provide a thrust stopper for securing both a camshaft and valve operating assembly in proper orientations within the cylinder head arrangement.

It is another object of the present invention to provide a thrust stopper that may be installed within a cylinder head housing without the use of fasteners.

It is another object of the present invention to provide a thrust stopper that is installed within a cylinder head housing and does not clatter within the housing.

It is another object of the present invention to provide a thrust stopper for securing both a camshaft and a pair of valve operating assemblies in proper orientations within the cylinder head arrangement.

It is yet another object of the present invention to provide a common thrust stopper design that is capable of being used in various engines and engine configurations.

SUMMARY OF THE INVENTION

In response to the foregoing challenges, applicants have developed a thrust stopper for use in a cylinder head arrangement of an internal combustion engine to retain a camshaft in a desired orientation while preventing axial movement of the same. The thrust stopper is configured essentially as a lock that is inserted into a receiving opening or recess in the cylinder head housing. It is contemplated that the thrust stopper can be used for different types of engines. Once the camshaft has been slid into a receiving bore in the cylinder head housing, the camshaft can be secured axially by inserting the thrust stopper into the receiving opening in the cylinder head housing. In order to simplify removal of the thrust stopper from the receiving opening, the receiving opening may incorporate a dismantling recess.

In accordance with the present invention, the thrust stopper includes a first orienting assembly for orienting the camshaft in a predetermined camshaft orientation within the cylinder head housing. The first orienting assembly includes a retaining section formed in the thrust stopper. The retaining section is sized to be received within a groove formed in an outer surface of the camshaft. The groove in the camshaft is located adjacent an end of the camshaft that is opposite to the camshaft drive assembly. The retaining section may have a reduced cross section or thickness with respect to the remainder of the thrust stopper. The retaining section is preferably assymetrically disposed with respect to a vertical mid-plane extending through the thrust stopper.

In accordance with the present invention, the thrust stopper includes a recess located adjacent the retaining section. The recess has a shape that corresponds to the cross section of the outer diameter of the camshaft. The location of the retaining section and the recess on the lower end of the thrust stopper permits the thrust stopper to be inserted into the cylinder head housing in only one orientation. This arrangement ensures that the thrust stopper and in particular the second orienting assembly, described below, is properly oriented. It is preferable that the retaining section is located on one side of the vertical mid-plane and the recess is located on an opposite side of the vertical mid-plane.

As discussed above, the retaining section fits in an annular groove in the camshaft to form an interlocking connection. The side surfaces of the retaining section of the first orienting assembly also serve as an axial bearing for the camshaft. The thrust stopper, and in particular, the retaining section of the first orienting assembly has a plate-like shape. Consequently, the receiving opening is preferably formed as a slot. The plate-like shape permits the retaining section of the thrust stopper to rest against the side surfaces of the annular groove over a relatively large area, which reduces wear. In order to absorb the considerable mechanical stresses in the area of the first orienting assembly, it is preferred that the thrust stopper be formed of a sintered metal.

To save space, the thrust stopper may be arranged in the cylinder head housing at an end of the camshaft that is remote from the camshaft drive system. The thrust stopper can be held captive by a rocker arm shaft and/or by a valve cover on the cylinder head housing. This prevents movement of the thrust stopper in the receiving opening. In some instances, the rocker arm shaft is positioned within the cylinder head housing such that rocker arm shaft secures the thrust stopper within the receiving opening in the cylinder head housing whereby a portion of the rocker arm shaft extends over the thrust stopper. No additional fasteners are needed to fix the thrust stopper in place within the cylinder head housing.

In accordance with the present invention, the thrust stopper may further include a breather channel formed therein. The breather channel forms a passageway from the recess in the thrust stopper adjacent the retaining section to prevent a pressure build up within the cylinder head housing adjacent the end face of the camshaft to avoid the buildup of pressure, which may create an axial froce against the end of the camshaft.

The thrust stopper is offset slightly from the camshaft in the radial direction so that there is no contact between the face surface of the thrust stopper and the cylindrical outside surface of the camshaft. A slight clearance is present between these components. The supporting surfaces of the thrust stopper, which are preferably arranged parallel to the axis of the camshaft, lie on corresponding fixed shoulders of the cylinder head housing, on opposing sides of the camshaft.

It is particularly advantageous if the thrust stopper is configured as a positioning device used to ensure that a valve operating assembly is positioned correctly along with the adjacent camshaft. In accordance with the present invention, the thrust stopper further includes a second orienting assembly for orienting the valve operating assembly in a predetermined operating position within the cylinder head housing. When the valve operating assembly includes a rocker arm shaft, the second orienting assembly is adapted to engage an end portion of the rocker arm shaft to maintain it in a predetermined rocker arm shaft orientation within the cylinder head housing.

It is contemplated that the first orienting assembly is located on one end or bottom side of the thrust stopper and the second orienting assembly is located on an opposite end or top side of the thrust stopper. The present invention, however, is not limited to such an arrangement; rather, it is contemplated that the first and/or second orienting assemblies may be located between the top and bottom sides of the thrust stopper.

In accordance with the present invention, the retaining section of the first orienting assembly and the second orienting assembly are located on the same side of the vertical mid-plane. Although it is not preferred, the retaining section and the second orienting assembly may be located on opposing sides of the vertical mid-plane. It is also contemplated that the first orienting assembly may include a second recess such that a first recess is positioned on one side of the retaining section and a second recess is positioned on an opposite side of the retaining section.

In accordance with the present invention, the second orienting assembly may include at least one interlocking assembly, wherein the interlocking assembly engages a portion of the valve operating assembly to create an interlocking connection between the thrust stopper and the valve operating assembly. The interlocking connection ensures that the valve operating assembly can only be installed in one predetermined position. This is especially important when the valve operating assembly, particularly the rocker arm shaft, is hollow and incorporates oil supply ports. Incorrect positioning of the oil supply ports may adversely impact the engine's lubrication system.

The interlocking assembly may include at least one projection. Each projection may take the form of a rib extending from a surface of the thrust stopper. The rib is adapted to be received within a recess within the rocker arm shaft. Alternatively, the rocker arm shaft may include a projection that is received within a recess in the thrust stopper.

It is contemplated that the thrust stopper in accordance with the present invention may be used in various types of engines. The number of cylinders in the engine may vary, the orientation of the cylinders may vary, and the configuration of the valve operating assemblies may vary. With this in mind, the interlocking assembly preferably includes a pair of projections.

The thrust stopper in accordance with the present invention may be used in an engine having a pair of rocker arm shafts containing rocker arms thereon that are driven by the cams on a common camshaft. The rocker arms positioned on one rocker arm shaft control the operation of the valves associated with the engine exhaust. The rocker arms positioned on the other rocker arm shaft control the operation of the valves associated with the engine intake. With this arrangement, a first rocker arm shaft engages one of the projections of the second orienting assembly and a second rocker arm shaft engages another projection spaced from the first rib.

The same thrust stopper design (with two ribs)may be used in a mirror-image cylinder head housing of an internal combustion engine having its cylinders arranged in a V-configuration. With this arrangement, one of the ribs or projections on one thrust stopper may be used to orient a first rocker arm shaft in one cylinder head housing and another rib or projection of another thrust stopper may be used to orient a second rocker arm shaft in the opposing cylinder head housing. In this manner, one projection or rib on each thrust stopper is non-functional, provided that only one rocker arm shaft is provided for each cylinder.

In any engine configuration, once the camshaft has been installed, the thrust stopper is slid into the slot-like receiving opening in the cylinder head housing and into the annular groove of the camshaft. Then, the rocker arm shaft is installed in the correct position in the cylinder head housing.

The present invention is also directed to a cylinder head arrangement for an internal combustion engine. The cylinder head arrangement includes a cylinder head housing and at least one camshaft located within the housing. Each camshaft has at least one cam formed thereon. The cams provide the necessary energy through a valve operating assembly to operate the intake and exhaust valves associated with the internal combustion engine. The cylinder head arrangement may include multiple cylinders or multiple banks of cylinders arranged in various configurations.

Various valve operating assemblies are contemplated to be within the scope of the present invention. For example, at least one rocker arm shaft may be located within the cylinder head housing. Each rocker arm shaft includes at least one rocker arm pivotably mounted thereon having a cam follower located on one end thereof. The cam follower operatively contacts one of the cams to transfer the motion of the cam to operate the required intake valve or exhaust valve. It is also contemplated that the cams on the camshaft may operate a valve operating assembly containing one or more hydraulic linkages. The hydraulic linkages transfer the motion of the cam to operate the required intake valve or exhaust valve. It is also contemplated that the valve operating assembly may be omitted. With this arrangement, the cams directly act upon the intake valve or exhaust valve to operate valves at predetermined times.

In accordance with the present invention, the cylinder head arrangement further includes a thrust stopper positioned within a receiving opening in the cylinder head housing. The thrust stopper includes a first orienting assembly for orienting the camshaft in a predetermined camshaft orientation within the cylinder head housing. The first orienting assembly prevents incorrect installation and axial movement of the camshaft along the camshaft axis within the cylinder head housing.

In accordance with the present invention, the cylinder head housing may include at least one dismantling recess located adjacent the receiving opening for the thrust stopper to permit access to the thrust stopper, which permits removal of the thrust stopper during a maintenance operation.

The cylinder head arrangement may further include a valve cover assembly secured to the cylinder head housing. It is contemplated that at least a portion of the valve cover assembly overlies the thrust stopper. The valve cover assembly prevents removal of the thrust stopper when installed.

The cylinder head arrangement may further include a sealing assembly positioned between the valve cover assembly and the cylinder head housing. At least a portion of the sealing assembly is positioned between the thrust stopper and the valve cover assembly. The sealing assembly reduces any clatter or movement of the thrust stopper within the receiving opening in the cylinder head housing. Clatter occurs when the thrust stopper vibrates within the receiving opening and periodically contacts the surrounding engine components and/or cylinder head housing.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
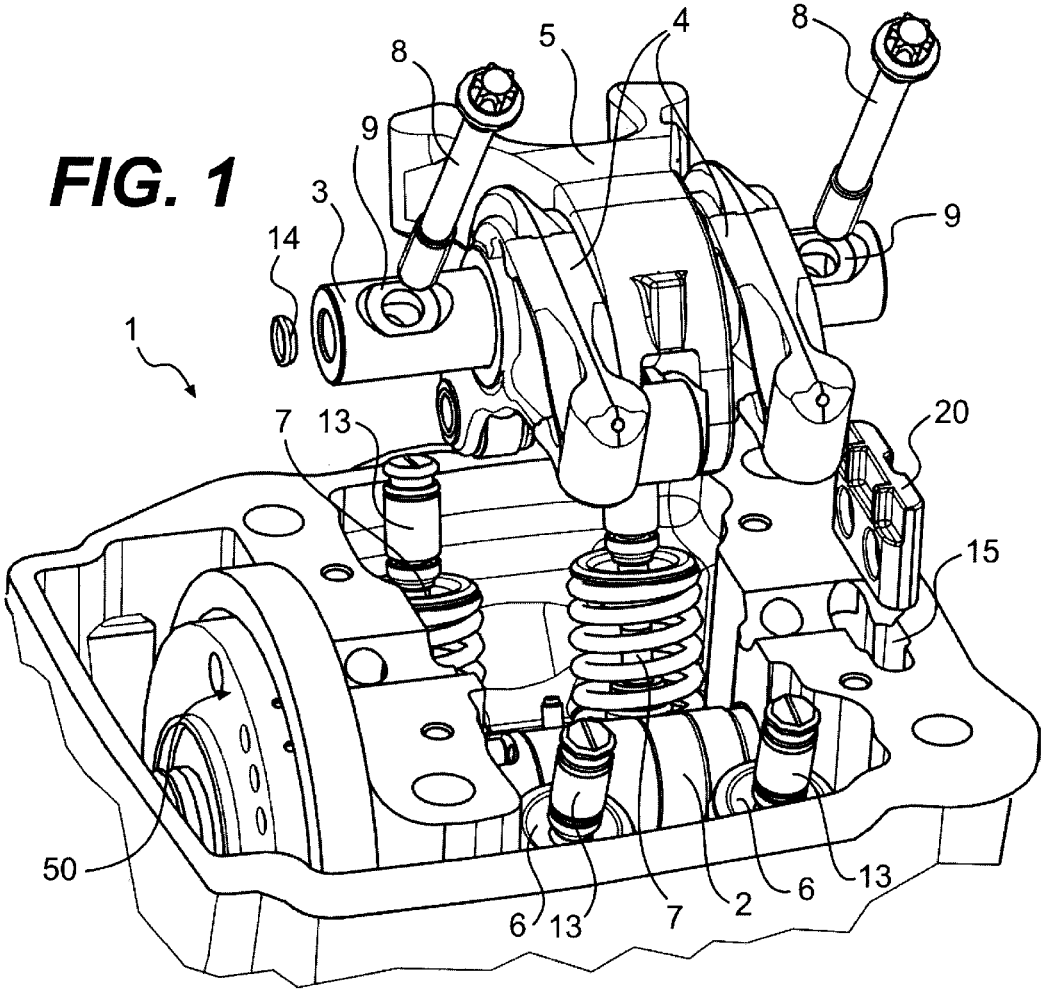
FIG. 1 is an exploded view of a cylinder head arrangement containing a thrust stopper device in accordance with the present invention.

A cylinder head arrangement for an internal combustion engine is illustrated in FIG. 1. The cylinder head arrangement includes a cylinder head housing 1. The cylinder head housing 1 includes a camshaft 2 mounted therein. The camshaft 2 includes one or more cams, which provide the energy to operate one or more intake valves and exhaust valves 6 and 7 at predetermined engine operating cycles. The energy from the cams on the camshaft 2 is transferred to the valves 6 and 7 through a valve operating assembly.

As illustrated in FIG. 1, the valve operating assembly includes a rocker arm shaft 3. One or more rocker arms 4 and 5 are pivotably mounted on the rocker arm shaft 3. The energy from the cams on the camshaft 2 is transferred via the rocker arms 4 and 5 to operate the valves 6 and 7. The present invention, however, is not limited to the use of rocker arms to deliver the energy from the cams to operate the valves 6 and 7; rather, various other valve operating assemblies are considered to be well within the scope of the present invention. For example, the cams may act directly on the valves 6 and 7. It is further contemplated that the rocker arms and rocker arm shaft may be replaced by a hydraulic linkage. The hydraulic linkage having a first piston that is operated by one of the cams on the camshaft 2 and another piston that contacts the valve in response to operation of the first piston.

In embodiment illustrated in FIG. 1, the rocker arm shaft 3 is secured to the cylinder head housing 1 by one or more attachment bolts 8. The present invention is not limited to the use of attachment bolts 8; rather, it is contemplated that other forms of fasteners may be used including by not limited to clips or brackets to secure the rocker arm shaft 3 to the cylinder head housing 1. The rocker arm shaft 3 could also be inserted into a bore formed in the cylinder head housing 1.

Figure 2:
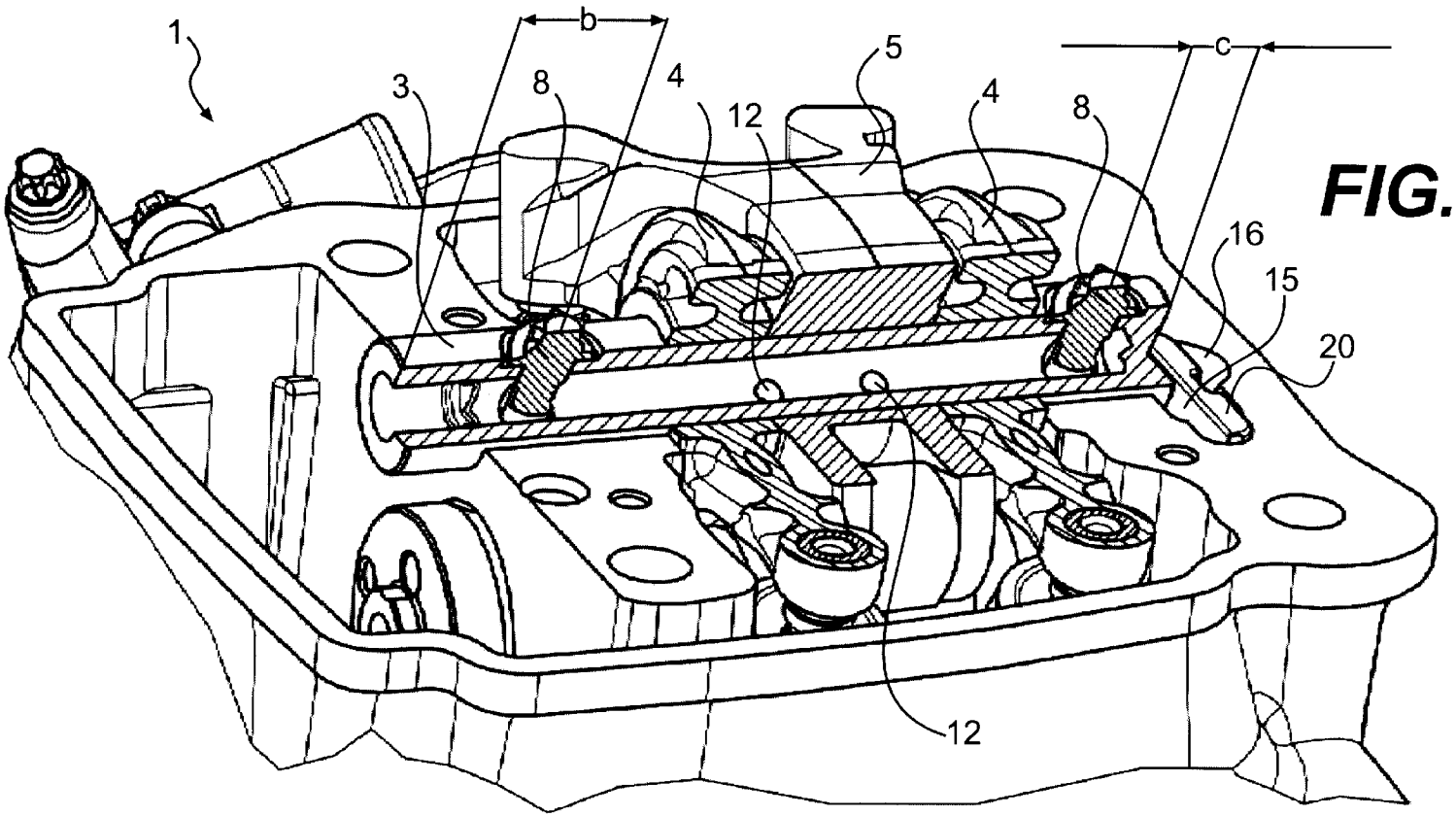
FIG. 2 is a partial cross section and perspective view of the cylinder head arrangement containing a thrust stopper device in accordance with one embodiment of the present invention wherein the thrust stopper does not include a second orienting assembly.
Figure 3:
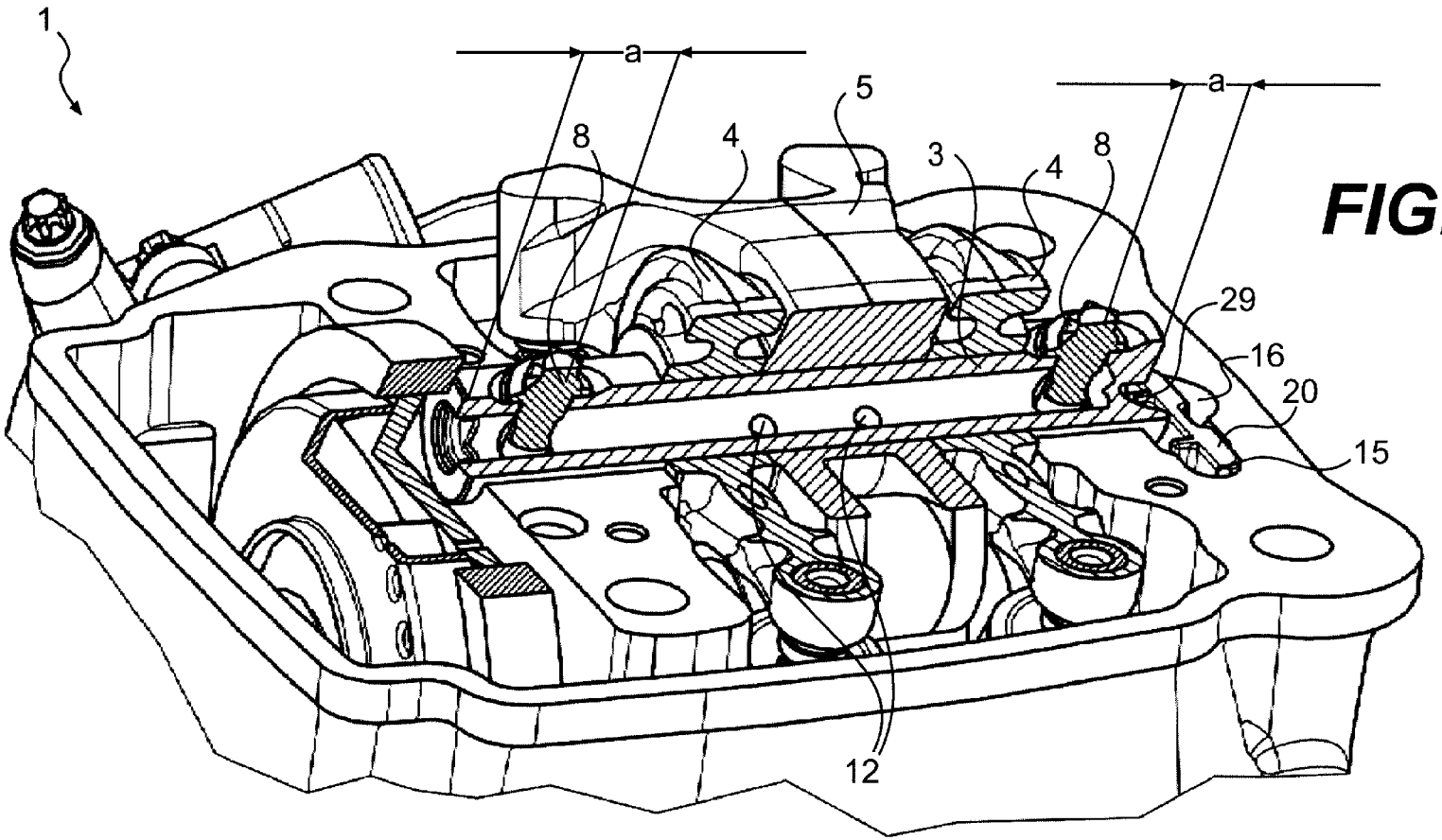
FIG. 3 is a partial cross section and perspective view of the cylinder head arrangement containing a thrust stopper device in accordance with one embodiment of the present invention wherein the thrust stopper includes a second orienting assembly.
Figure 5:
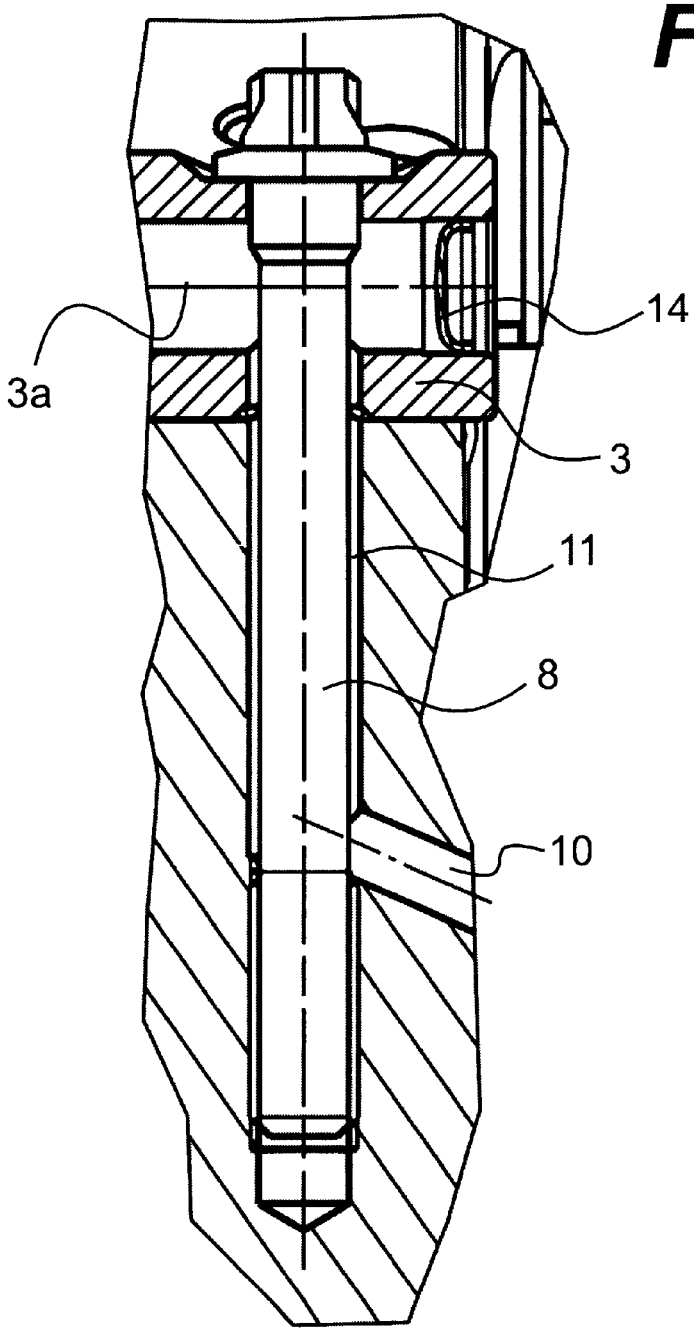
FIG. 5 is a partial view of the rocker arm shaft, a connection assembly for the same and a lubricant supply in accordance with the present invention.

As shown in FIG. 5, the rocker arm shaft 3 has a hollow construction. With this arrangement, lubricating oil can be supplied through the rocker arm shaft 3 to the rocker arms 4 and 5 through openings 12, as shown in FIGS. 2 and 3, to lubricate the bearings (not shown) in the rocker arms. The lubricating oil may also be supplied to operate the hydraulic tappet clearance adjusters 13. The lubricating oil is supplied through at least one bore 10 in the cylinder head housing 1. The bore 10 is in fluid communication with the bore 11, which receives an attachment bolt 8. As shown in FIG. 5, the fastener 8 has an area of reduced cross-section. With this construction, the lubricating oil may flow from the bore 10 around the fastener 8 in the bore 11 to the interior portion of the rocker arm shaft 3. The head of the fastener 8 rests against a flat surface 9 formed in the rocker arm shaft 3. The inclusion of the flat surface 9 ensures that the rocker arm shaft 3 is properly oriented. A cap or plug 14 is provided to close off at least one end of the hollow rocker arm shaft 3.

A thrust stopper 20 in accordance with the present invention will now be described in greater in detail. The thrust stopper 20 is provided to ensure proper orientation of the camshaft 2 and the valve operating assembly. The thrust stopper 20 also ensures that the camshaft 2 is axially secured within the cylinder head housing 1. As illustrated in FIG. 1, the thrust stopper 20 is received within a slot-shaped receiving opening 15 in the cylinder head housing 1.

Figure 4:
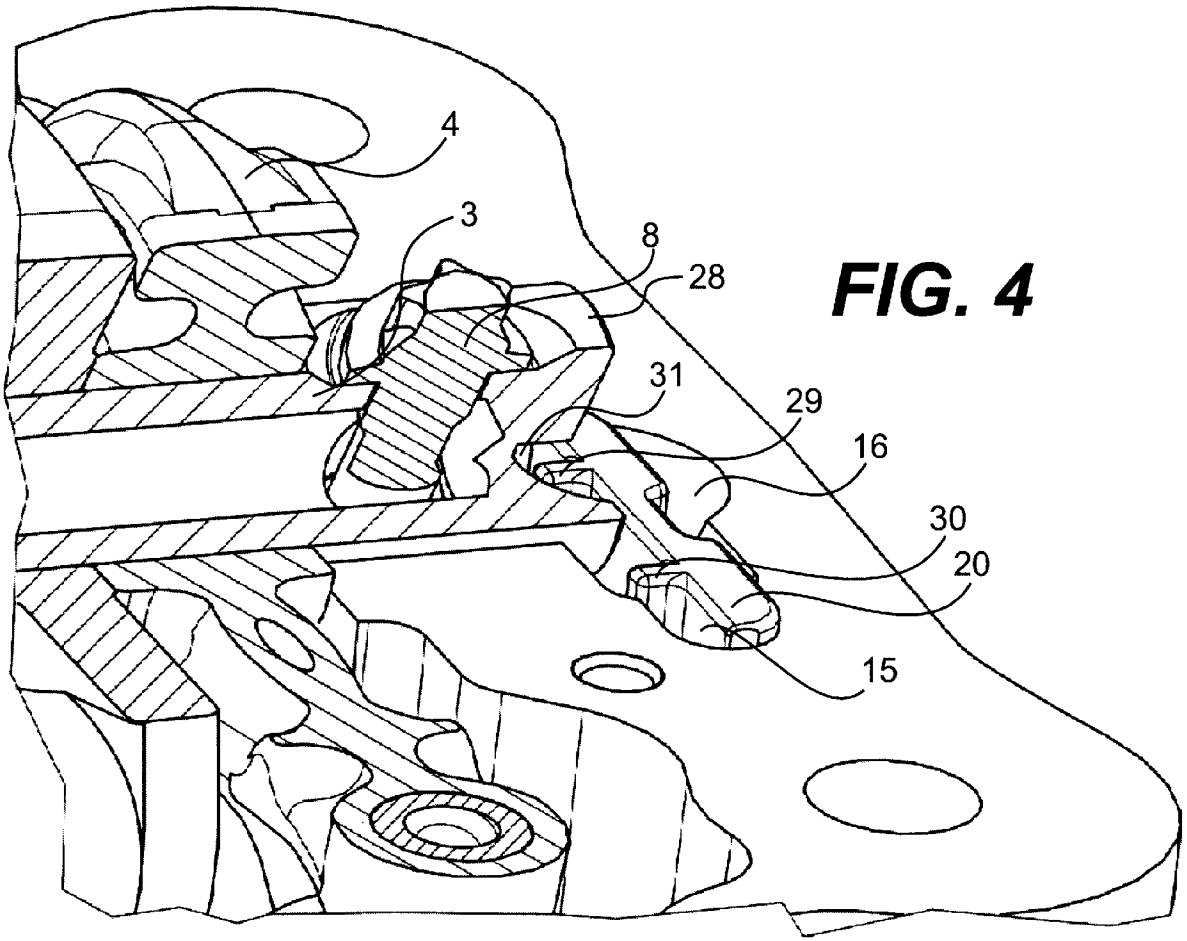
FIG. 4 is a partial enlarged view of FIG. 3 illustrating the second orienting assembly in detail.

As shown in FIGS. 2–4, at least one dismantling recess 16 is provided adjacent the receiving opening 15 to permit simple removal of the thrust stopper 20 from the receiving opening 15 in the cylinder head housing 1 in the event of disassembly. The dismantling recess 16 is sufficiently sized to accommodate a suitable tool to permit withdrawal of the thrust stopper 20 from the opening 15. It is also contemplated that the thrust stopper 20 can be withdrawn from the opening 15 directly with the fingers of the mechanic or service technician.

The thrust stopper 20 is preferably formed as a unitary sintered metal part. The present invention, however, is not limited to the use of sintered metals; rather, it is contemplated that the thrust stopper 20 may be formed from a forged metal or a machined metal. It is also contemplated that the thrust stopper 20 may be formed from a high strength composite or ceramic material provided the material is capable of absorption the considerable mechanical stresses associated with securing the camshaft 2 in place within the cylinder head housing 1.

Figure 6:
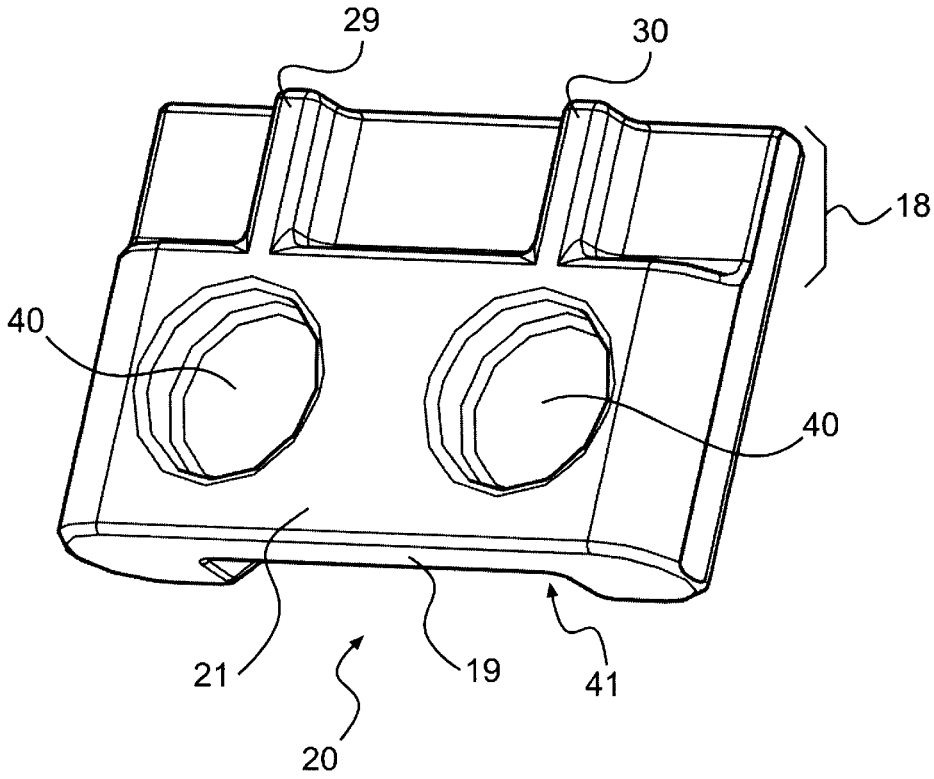
FIG. 6 is a schematic view of the thrust stopper illustrating the second orienting assembly.
Figure 7:
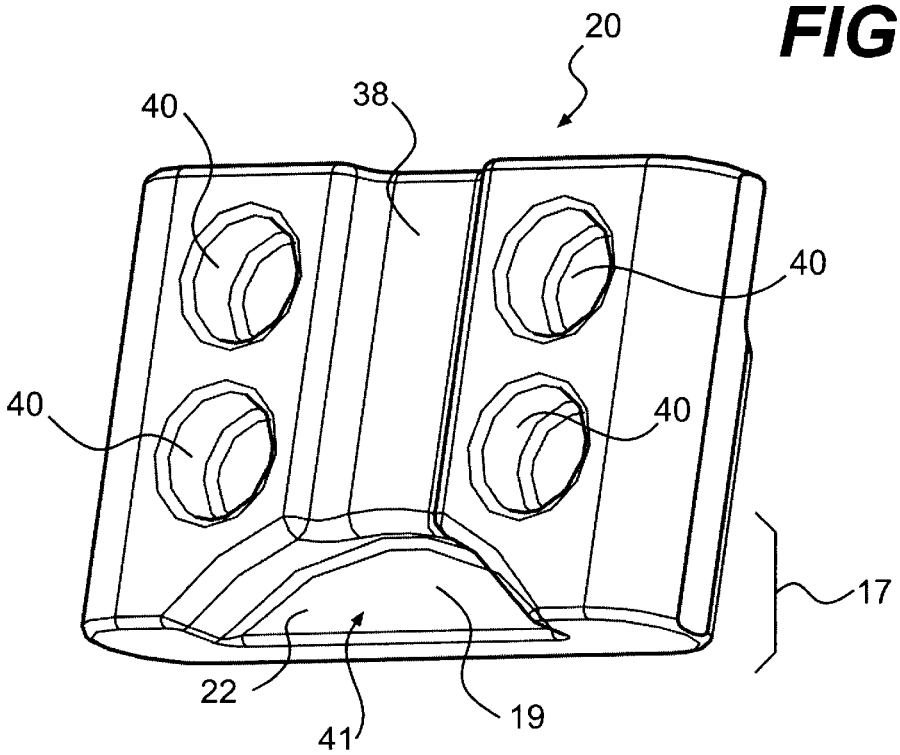
FIG. 7 is a schematic view of the thrust stopper illustrating the first orienting assembly.
Figure 8:
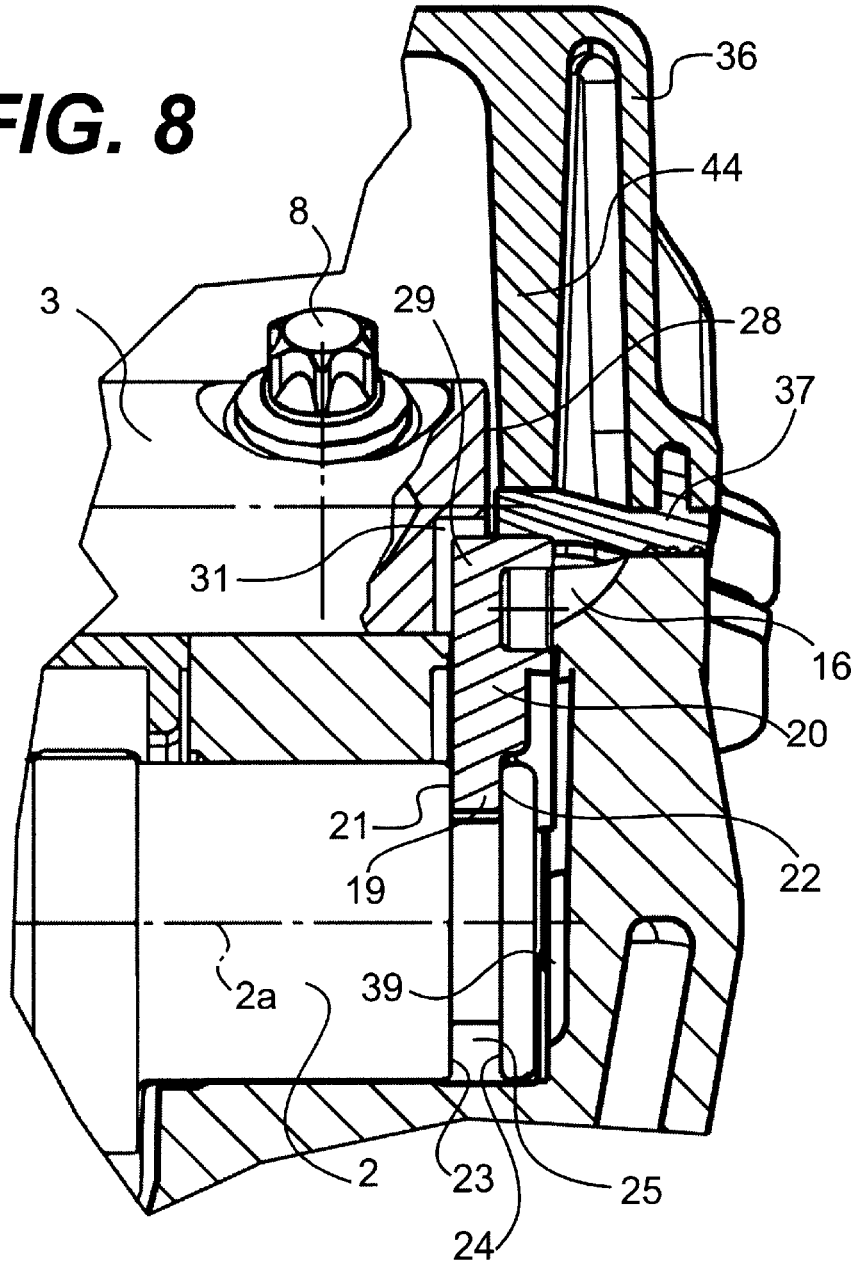
FIG. 8 is a cross sectional side view of the cylinder head arrangement through line IX—IX in FIG. 10 illustrating a rocker arm shaft and a valve cover assembly overlying the thrust stopper and an elastomeric sealing assembly contacting the thrust stopper in accordance with the present invention.
Figure 9:
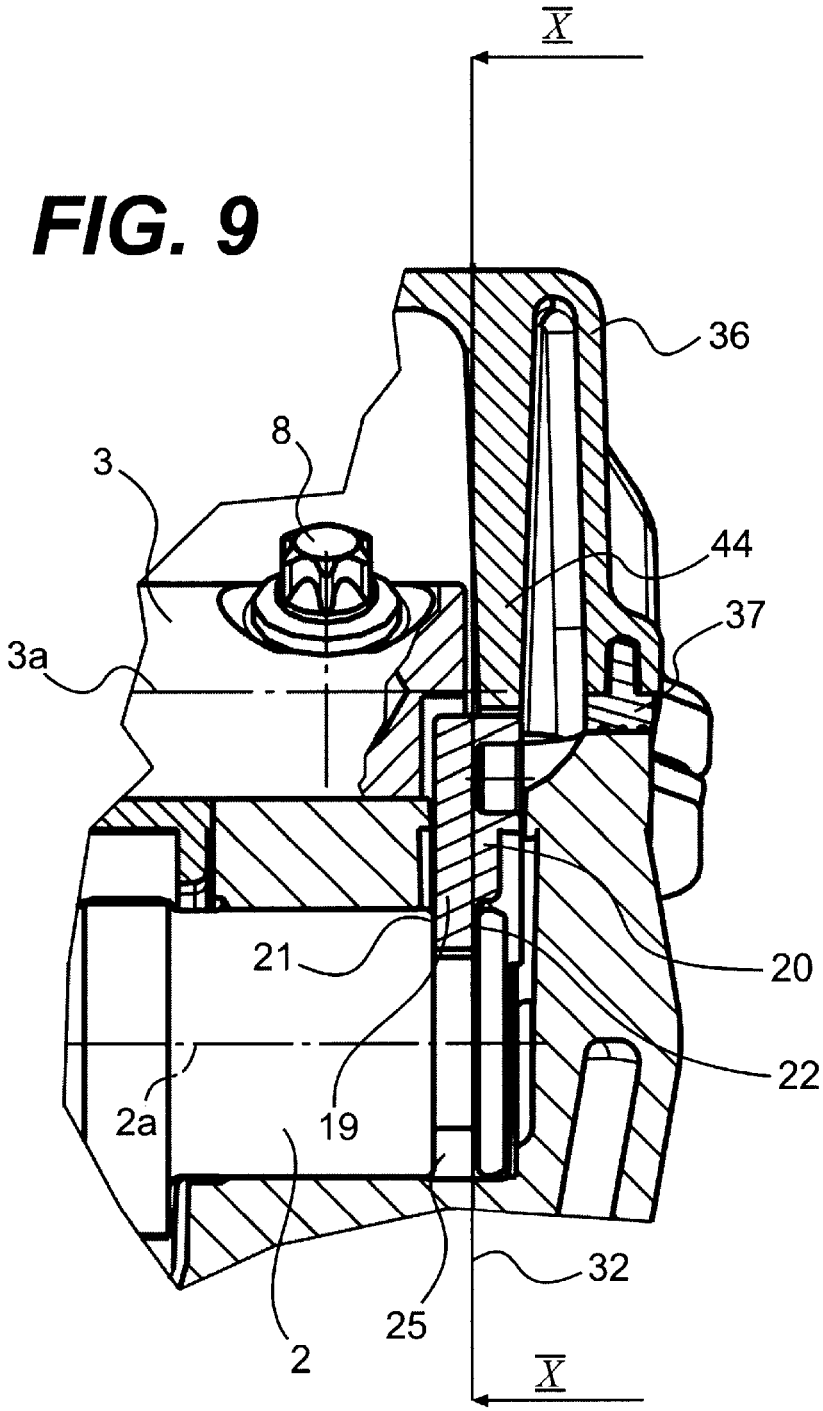
FIG. 9 is a cross sectional side view of the cylinder head arrangement through line IX—IX in FIG. 10 illustrating a rocker arm shaft and a valve cover assembly overlying the thrust stopper in accordance with the present invention.

The thrust stopper 20 includes a first orienting assembly 17 located on a lower end thereof. The first orienting assembly 17 has a retaining section 19 formed therein. As shown in FIGS. 6 and 7, the retaining section 19 is formed from an area of the thrust stopper 20 having a reduced thickness. As shown in FIGS. 8 and 9, the thrust stopper 20 preferably has an assymmetrical configuration with respect to the vertical mid-plane. The retaining section 19 is sized to permit insertion of the same into an annular groove 25 formed in the camshaft 2. The retaining section 19 includes a pair of opposing retaining surfaces 21 and 22. The surfaces 21 and 22 are sized to engage the corresponding annular stop surfaces 23 and 24 of the camshaft 2 to prevent movement of the camshaft 2 along the camshaft axis 2*a*.

Figure 10:
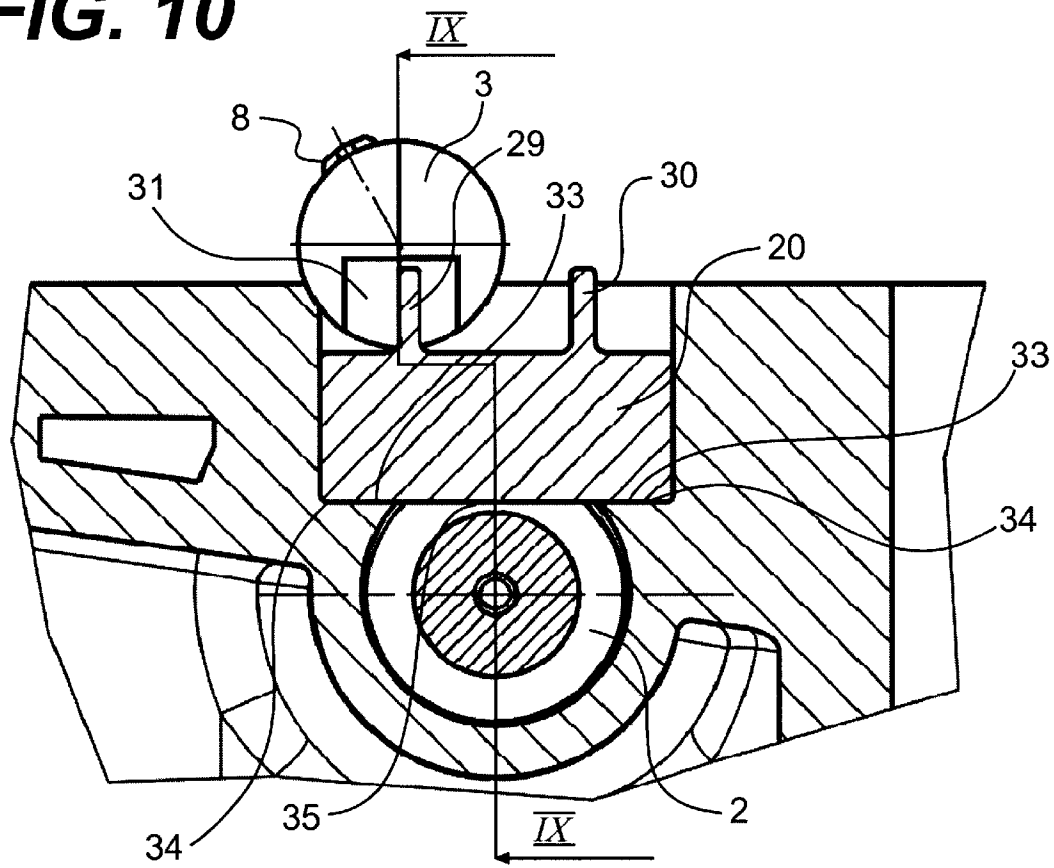
FIG. 10 is a cross sectional end view of the cylinder head arrangement through line X—X in FIG. 9.

When in an installed position, the thrust stopper 20 is inserted into the receiving opening 15. The retaining section 19 is positioned within the annular groove 25 in the camshaft 2, as shown in FIGS. 8–10. There is a small amount of clearance between the retaining surfaces 21 and 22 and the annular stop surfaces 23 and 24 on the camshaft 2. With this arrangement, the first orienting assembly 17 on the thrust stopper 20 ensures the proper axial orientation of camshaft 2.

As shown in FIG. 9, the retaining surfaces 21 and 22 of the retaining section 19 are arranged so as to be asymmetrical relative to a center plane 32 of the thrust stopper 20. This configuration prevents the incorrect installation of the thrust stopper 20. If the thrust stopper 20 is inserted in the receiving opening 15 in the reverse position (i.e., opposite to what is shown in FIGS. 8 and 9), the retaining section 19 will not be positioned within the annular groove 25. The thrust stopper 20 will then extend above the cylinder head housing 1, which provides the engine assembler with a visual indication the thrust stopper 20 is not properly installed and that the camshaft 2 may not be in proper axial alignment. In the unlikely event that the engine assembler does not recognize the incorrect orientation of the thrust stopper 20 upon insertion of the thrust stopper 20 in the opening 15, the assembler will quickly recognize this error when unable to properly align the valve operating assembly, which is described in great detail below.

The rotation of the camshaft 2 is not hampered by the placement of the retaining section of the thrust stopper 20 in the annular groove 25. A recess 41 is formed in the thrust stopper 20 adjacent the retaining section 19. The recess 41 is sized and shaped to correspond to the circumference of an outer portion of the camshaft 2. A small clearance 35 is formed between the camshaft 2 and the lower surface of the first orienting assembly 17, as shown in FIGS. 8–10, when the camshaft 2 is positioned within the recess 41. The lower end of the thrust stopper 20 includes at least one support surface 33. As shown in FIG. 10, the support surface 33 contacts a shoulder 34 formed in the cylinder head housing 1. The provision of at least one support surface 33 and more preferably a pair of support surfaces ensures that the thrust stopper 20 does not lie directly on the camshaft 2 within the annular groove 25 or any outer cylindrical surface of the camshaft 2. Instead the weight of the thrust stopper 20 and any force acting thereon from the valve operating assembly and valve cover 36 is transferred to the shoulders 34 formed in the cylinder head housing 1.

The mounting of various rocker arm shafts 3 using the thrust stopper 20 in accordance with the present invention will now be described in greater detail. Although the thrust stopper 20 is preferably used in connection with a valve operating assembly having a rocker arm shaft 3, the present invention is not limited to engines having rocker arm shafts. As discussed above, other valve operating assemblies are considered to be well within the scope of the present invention. Furthermore, it is contemplated that one or more rocker arm shafts 3 may be provided.

FIG. 2 illustrates one possible rocker arm shaft arrangement within the cylinder head housing 1. The rocker arm shaft 3 has hollow construction to permit the flow of a suitable lubricant to the rocker arms 4 and 5. The lubricant flows to the hollow portion of the rocker arm shaft 3 through the passageways 11 formed in the cylinder head housing 1, as shown for example in FIG. 5. The rocker arm shaft 3 illustrated in FIG. 2 includes a pair of fasteners 8. The free ends of the rocker arm shaft are spaced at differing distances from the fasteners 8. The spacing b between one end of the shaft 3 and the fastener 8 is greater than the spacing c between an opposite end of the shaft 3 and the other fastener 8.

With such a rocker arm shaft arrangement, the rocker arm shaft 3 can only be installed in the position shown in FIG. 2. The rocker arm shaft 3 would not fit within the cylinder head housing 1 if the positioning were reversed. The positioning of the thrust stopper 20 in the receiving opening 15 would prevent this improper mounting because the shaft 3 would overlie the thrust stopper 20 whereby an upper portion of the thrust stopper 20 would interfere with the positioning of the rocker arm shaft 3. Incorrect positioning of the rocker arm shaft 3 leads to the misalignment of the lubricant supply ports 11 and the openings 12.

It, however, is possible to improperly install the rocker arm shaft 3 when the shaft 3 is rotated through 180 degrees about the rocker arm shaft axis 3*a*. In this position, the flat portions 9 of the shaft 3 would be positioned adjacent the cylinder head housing 1. As discussed above, the fasteners 8 include head portions, which are intended to abut against the flat portions 9. If during assembly, the assembler realizes that the head portions are not abutting the flat portions 9, the rocker arm shaft 3 can be rotated 180° about the axis 3*a* into the proper orientation. This provides limited protection against improper orientation.

FIG. 3 illustrates another possible rocker arm shaft arrangement within the cylinder head housing 1. Like the rocker arm shaft 3, described above, there is a hollow construction to permit the flow of a suitable lubricant to the rocker arms 4 and 5 and the hydraulic tappet clearance adjusters 13. The rocker arm shaft 3 illustrated in FIG. 3 also includes a pair of fasteners 8. The free ends of the rocker arm shaft are spaced at the same distance or spacing a from the fasteners 8.

With such a rocker arm shaft arrangement, the rocker arm shaft 3 can be installed in the position shown in FIG. 3. The rocker arm shaft 3 can also be improperly installed if the positioning were reversed (i.e., the ends of rocker arm shaft 3 are switched). Such an inverse positioning may adversely impact the alignment of the lubricant supply ports 11 and the openings 12 and thereby the circulation of the lubricating oil. The second orienting assembly 18 will prevent the installation of the shaft 3 in this manner. In some instances (e.g., when the openings 12 are equally spaced from the fasteners 8), the reverse positioning of the rocker arm shaft 3 would not impact the lubrication system or the operation of the internal combustion engine. In such a system, only the axial orientation of the rocker arm shaft 3 about the axis 3*a* is of concern.

Like the rocker arm shaft described in connection with FIG. 2, it is possible to improperly install the rocker arm shaft 3 when the shaft 3 is rotated through 180 degrees about the rocker arm axis 3*a*. The flat portions 9 on the rocker arm shaft 3 and the second orienting assembly 18 will, however, prevent the installation of the shaft 3 in this manner.

The second orienting assembly 18 of the thrust stopper 20 will now be described in greater detail. The second orienting assembly 18 provides protection against the rocker arm shaft 3 of FIG. 3 from being installed when rotated about the axis 3*a* of the rocker arm shaft or when the ends of the rocker arm shaft 3 are reversed.

The second orienting assembly 18 has an interlocking assembly that acts in combination with a corresponding interlocking assembly on one end 28 of the rocker arm shaft 3. The interlocking assembly includes at least one projection or rib 29 formed on the thrust stopper 20. The rib 29 is sized to be received within a recess 31 formed on the end 28 of the rocker arm shaft 3. The recess 31 is preferably located on the rocker arm shaft 3 on an end that is opposite to the location of the drive side 50 of the camshaft 2. The opposite end of the rocker arm shaft 3 does not include a recess 31. Instead a conventional end plug 14 is provided. The provision of the recess 31 on only one end of the rocker arm shaft 3 prevents the rocker arm shaft from being flipped when installed. The lack of a recess 31 on one end prevents that end from engaging the projection or rib 29.

The present invention is not limited to a projection or rib 29 being located on the thrust stopper 20; rather, it is contemplated that the location of the rib 29 may be changed such that the rocker arm shaft 3 includes a projection extending from one end thereof and the thrust stopper 20 includes a complementary recess. It is further contemplated that the thrust stopper 20 and the end of the rocker arm shaft 3 may include one or more interlocking teeth formed thereon.

The recess 31 in the end 28 of the rocker arm shaft 3 is preferably asymmetrically formed relative to the axis 3*a* of the rocker arm shaft 3. The asymmetrical location of the recess 31 prevents incorrect installation of the rocker arm shaft 3 about the axis 3*a*. With this arrangement, the rocker arm shaft 3 can only be installed within the cylinder head housing 1 in one orientation. It cannot be rotated through 180 degrees about the rocker arm axis 3*a*. The incorrect installation of the rocker arm shaft 3, either when reversed end for end or when rotated about the rocker arm axis 3*a*, can be prevented.

Although the cylinder head housing 1 illustrated in FIG. 1 has a single rocker arm shaft 3, the present invention is not limited to engines having such an arrangement; rather, it contemplated that various cylinder head arrangements having multiple rocker arm shafts are well within the scope of the present invention. The thrust stopper 20 is intended to be used with various types, sizes and configurations of engines. To permit use in different engine configurations, the second orienting assembly 18 preferably includes a pair of ribs or projections 29 and 30, as shown in FIGS. 1, 3, 4, 6, and 10. The ribs 29 and 30 are preferably formed parallel to each other in a spaced relationship. The ribs 29 and 30 are preferably symmetrically located on opposite sides of a normal plane. The thrust stopper 20 can orient a pair of rocker arm shafts 3 when the pair of rocker arm shafts 3 are located on opposing sides of the camshaft 2. With this arrangement, a first rocker arm shaft engages projection 29 and a second rocker arm shaft engages projection 30.

The same thrust stopper design may be applied to mirror-image cylinder head housings on opposite sides of an internal combustion engine having its cylinders in a V-configuration. With this arrangement, one projection 29 on one thrust stopper 20 orients the rocker arm shaft 3 of the first cylinder head housing. The other projection 30 of another thrust stopper 20 is used to orient the rocker arm shaft 3 of the second cylinder head housing. The present invention reduces the number of unique parts required for each engine design. One projection on each thrust stopper 20 is non-functional, provided that only one rocker arm shaft is provided for each cylinder.

Unlike the prior art, the thrust stopper 20 in accordance with the present invention is held in place without the need of additional fasteners. The thrust stopper 20 is secured within the cylinder head housing 1 by either the rocker arm shaft 3 or a valve cover assembly 36. As shown in FIG. 8, a portion of the rocker arm shaft 3 extends over the upper portion of the thrust stopper 20. The valve cover assembly 36 is secured to the cylinder head housing 1. The valve cover assembly 36 may include a projection or rib 44 that extends over a portion of the upper portion of the thrust stopper 20. The clearance between the rocker arm shaft 3 and the thrust stopper 20 is smaller than the clearance between the thrust stopper 20 and the projection 44. As such, the rocker arm shaft 3 prevents removal of the thrust stopper 20 from the opening 15 (the thrust stopper 20 would contact the rocker arm shaft 3 prior to contacting the projection 44). Once the rocker arm shaft 3 is secured to the cylinder head housing 1 using the fasteners 8, the thrust stopper 20 can not be removed from the receiving opening 15. In the arrangement shown in FIG. 8, the projection 44 is provided to serve as a stop for an elastic valve cover seal 37. The elastic valve cover seal 37 projects into the area between the rib 44 of the valve cover assembly 36 and the thrust stopper 20. The elastic valve cover seal 37 prevents the thrust stopper 20 from clattering within the receiving opening 15. The present invention, however, is not limited to the use of the projection 44 and the seal 37. It is contemplated that one or more of these elements may be omitted.

In the arrangement shown in FIG. 9, the valve cover assembly 36 prevents removal of the thrust stopper 20 from the receiving opening 15. As shown in FIG. 9, the valve cover assembly 36 includes a projection or rib 44 that is positioned above the thrust stopper 20 adjacent the rocker arm shaft 3. The clearance between the rib 44 and the thrust stopper 20 is smaller than the clearance between the rocker arm shaft 3 and the thrust stopper 20. As such, the rib 44 of the cover assembly 36 acts as a stop to secure the thrust stopper 20 (the thrust stopper 20 would contact the projection 44 prior to contacting the rocker arm shaft 3). The projection 44 in FIG. 9 has a greater length than the projection 44 of FIG. 8.

The use of the valve cover assembly 36 having a rib 44 is especially useful in securing the thrust stopper 20 in place when the second orienting assembly 18 has been omitted, as shown in FIG. 2 or when the rocker arm shaft 3 does not overlap the thrust stopper 20. In this arrangement, it is contemplated that the valve cover seal 37 may be added to eliminate clatter.

The thrust stopper 20 also incorporates a breather assembly 38. The breather assembly 38 ensures that no excess pressure can build up in the space or gap 39, shown in FIG. 8, that adjoins the face end of the camshaft. Excess pressure at this point would exert a thrust on the camshaft 20 and would also subject the first orienting assembly to wear. The breather assembly 38 is preferably formed as a groove or slot in the thrust stopper 20, as shown in FIG. 7. The present invention, however, is not limited to a centrally positioned groove; rather, it is contemplated that the location of the groove may vary provided it permits the venting of gases. Furthermore, it is contemplated that the breather assembly may be formed as a bore within the thrust stopper 20.

Various recesses 40 are provided in the thrust stopper 20 to reduce weight without reducing the strength of the thrust stopper 20. The location and number of recesses 40 may vary. It is further contemplated that the recesses 40 may be omitted in their entirety without adversely impacting the performance of the thrust stopper 20. It is also contemplated that the spatial relationship between the first orienting assembly 17 and the annular groove 25 in the camshaft 2 further reduces the clatter.

While the invention has been described in connection with what is presently considered to be the most practical and preferred embodiments, it is to be understood that the invention is not to be limited to the disclosed embodiments and elements, but, to the contrary, is intended to cover various modifications, combinations of features, equivalent arrangements, and equivalent elements included within the spirit and scope of the appended claims. Furthermore, the dimensions of features of various components that may appear on the drawings are not meant to be limiting, and the size of the components therein can vary from the size that may be portrayed in the figures herein. Thus, it is intended that the present invention covers the modifications and variations of the invention, provided they come within the scope of the appended claims and their equivalents.

What is claimed is:

1. A cylinder head arrangement for an internal combustion engine, comprising:

a cylinder head;

at least one camshaft located within the cylinder head, wherein the at least one camshaft having a camshaft axis, wherein the at least one camshaft having at least one cam formed thereon; and a thrust stopper, wherein the thrust stopper includes a first orienting assembly for, at least partly, defining the position of the at least one camshaft within the cylinder head, wherein the cylinder head having an opening therein for accommodating the thrust stopper, the opening being arranged as to fix the thrust stopper with respect to the camshaft axis.

2. The cylinder head arrangement according to claim 1, wherein the first orienting assembly includes a retaining section formed in the thrust stopper, wherein the retaining section is sized to be received within a groove formed in an outer surface of the camshaft.

3. The cylinder head arrangement according to claim 2, wherein at least a portion of the retaining section forms a bearing surface for the camshaft.

4. The cylinder head arrangement according to claim 2, wherein the camshaft is rotatable about a camshaft axis, wherein the first orienting assembly prevents axial movement of the camshaft along the camshaft axis within the cylinder head housing.

5. The cylinder head arrangement according to claim 1, wherein the cylinder head housing further comprises:

at least one dismantling recess located adjacent the opening to permit access to the thrust stopper to permit removal of the thrust stopper during a maintenance operation.

6. The cylinder head arrangement according to claim 1, further comprising a valve cover assembly secured to the cylinder head housing, wherein at least a portion of the valve cover assembly overlaps one end of the thrust stopper to prevent removal of the thrust stopper from the opening.

7. The cylinder head arrangement according to claim 6, further comprising a sealing assembly positioned between the valve cover assembly and the cylinder head housing, wherein at least a portion of the sealing assembly is positioned between one end of the thrust stopper and the valve cover assembly.

8. A cylinder head arrangement for an internal combustion engine, comprising:

a cylinder head housing;

at least one camshaft located within the housing, wherein the at least one camshaft having at least one cam formed thereon; and a thrust stopper positioned within an opening in the cylinder head housing, wherein the thrust stopper includes first orienting assembly for orienting one camshaft in a predetermined camshaft orientation within the cylinder head housing, wherein the thrust stopper further comprising a breather channel formed therein, wherein the breather channel forms a passageway from a portion of the cylinder head housing surrounding the camshaft adjacent the first orienting assembly to prevent a pressure build up within the cylinder head housing adjacent an end of the camshaft.

9. A cylinder head arrangement for an internal combustion engine, comprising:

a cylinder head housing;

at least one camshaft located within the housing, wherein the at least one camshaft having at least one cam formed thereon;

at least one valve assembly;

at least one valve operating assembly, wherein the at least one valve operating assembly is operatively connected to the at least one valve assembly; and a thrust stopper positioned within an opening in the cylinder head housing, wherein the thrust stopper includes first orienting assembly for orienting one camshaft in a predetermined camshaft orientation within the cylinder head housing and a second orienting assembly for orienting the at least one valve operating assembly in a predetermined orientation within the cylinder head housing.

10. The cylinder head arrangement according to claim 9, wherein the first orienting assembly is located on one end of the thrust stopper and the second orienting assembly is located on an opposite end of the thrust stopper.

11. The cylinder head arrangement according to claim 9, wherein the second orienting assembly includes at least one interlocking assembly, wherein the at least one interlocking assembly engages a portion of a free end of the at least one valve operating assembly.

12. The cylinder head arrangement according to claim 11, wherein the interlocking assembly includes at least one projection.

13. The cylinder head arrangement according to claim 12, wherein one projection is received within a positioning recess formed in an end portion of the valve operating assembly.

14. The cylinder head arrangement according to claim 13, wherein the valve operating assembly includes at least one rocker arm for operating the valve assembly and a rocker arm shaft, wherein the positioning recess is asymetrically positioned on an end of the rocker arm shaft with respect to a central axis of the rocker arm shaft.

15. The cylinder head arrangement according to claim 9, wherein the at least one valve operating assembly comprises:

at least one rocker arm shaft located within the cylinder head housing, wherein the at least one rocker arm shaft having at least one rocker arm pivotably mounted thereon, wherein each rocker arm having a cam follower located on one end thereof, whereby the cam follower operatively contacts one of the at least one cam.

16. The cylinder head arrangement according to claim 15, wherein the second orienting assembly includes at least one projection, wherein the projection is received within a positioning recess formed in an end portion of the rocker arm shaft.

17. The cylinder head arrangement according to claim 16, wherein the positioning recess is asymetrically positioned with respect to a central axis of the rocker arm shaft.

18. The cylinder head arrangement according to claim 15, wherein the at least one rocker arm shaft overlies the thrust stopper to prevent removal of the thrust stopper from the opening in the cylinder head housing.

19. The cylinder head arrangement according to claim 9, further comprising a valve cover assembly secured to the cylinder head housing, wherein at least a portion of the valve cover assembly overlaps one end of the thrust stopper to prevent removal of the thrust stopper from the opening.

20. The cylinder head arrangement according to claim 19, further comprising a sealing assembly positioned between the valve cover assembly and the cylinder head housing, wherein at least a portion of the sealing assembly is positioned between one end of the thrust stopper and the valve cover assembly.

21. The cylinder head arrangement according to claim 9, wherein the second orienting assembly includes a pair of ribs extending from a surface of the thrust stopper, wherein at least one of the pair of ribs is received within a recess within the valve operating assembly.

22. The cylinder head arrangement according to claim 2, wherein the thrust stopper includes a plate assembly, wherein the plate assembly extends in a direction generally perpendicular to a central axis of the camshaft.

23. The cylinder head arrangement according to claim 22, wherein the plate assembly contains a mid-plane, wherein mid-plane is substantially perpendicular to the central axis of the camshaft, wherein the first orienting assembly is assymmetrically disposed with respect to the mid-plane.

24. The cylinder head arrangement according to claim 23, wherein the plate assembly is formed from a sintered metal.

25. The cylinder head arrangement according to claim 23, further comprising:

at least one valve assembly;

at least one valve operating assembly, wherein the at least one valve operating assembly is operatively connected to the at least one valve assembly; wherein the thrust stopper further comprising:

a second orienting assembly for orienting the at least one valve operating assembly in a predetermined orientation within the cylinder head housing.

26. The cylinder head arrangement according to claim 25, wherein the first orienting assembly and the second orienting assembly are located on the same side of the mid-plane.

27. A thrust stopper for use in a cylinder head arrangement of an internal combustion engine, wherein the cylinder head arrangement includes a cylinder head having a receiving opening formed therein, and a camshaft located within the cylinder head, wherein the camshaft has a central axis, the thrust stopper comprising:

a plate assembly, wherein the plate assembly is positioned within the receiving opening to fix the plate assembly with respect to the central axis, wherein the plate assembly extends in a direction generally perpendicular to a central axis of the camshaft; and first orienting assembly formed on the plate assembly for orienting the camshaft in a predetermined camshaft orientation within the cylinder head.

28. The thrust stopper according to claim 27, wherein the first orienting assembly includes a retaining section formed in the thrust stopper, wherein the retaining section is sized to be received within a groove formed in an outer surface of the camshaft.

29. The thrust stopper according to claim 28, wherein at least a portion of the retaining section forms a bearing surface for the camshaft.

30. The thrust stopper according to claim 27, wherein the plate assembly is formed from a sintered metal.

31. A thrust stopper for use in a cylinder head arrangement of an internal combustion engine, wherein the cylinder head arrangement includes a cylinder head housing having a receiving opening formed therein, and a camshaft located within the housing, wherein the camshaft has a central axis, the thrust stopper comprising:

a plate assembly, wherein the plate assembly is positioned within the receiving opening, wherein the plate assembly extends in a direction generally perpendicular to a central axis of the camshaft;

first orienting assembly formed on the plate assembly for orienting the camshaft in a predetermined camshaft orientation within the cylinder head housing; and a breather channel formed therein, wherein the breather channel forms a passageway from a portion of the cylinder head housing surrounding the camshaft adjacent the first orienting assembly to prevent a pressure build up within the cylinder head housing adjacent an end of the camshaft.

32. A thrust stopper for use in a cylinder head arrangement of an internal combustion engine, wherein the cylinder head arrangement includes a cylinder head housing having a receiving opening formed therein, and a camshaft located within the housing, wherein the camshaft has a central axis, the thrust stopper comprising:

a plate assembly, wherein the plate assembly is positioned within the receiving opening, wherein the plate assembly extends in a direction generally perpendicular to a central axis of the camshaft; and first orienting assembly formed on the plate assembly for orienting the camshaft in a predetermined camshaft orientation within the cylinder head housing, wherein the cylinder head arrangement further includes at least one rocker arm shaft located within the housing, and the thrust stopper further comprising a second orienting assembly for orienting the at least one rocker arm shaft in a predetermined rocker arm shaft orientation within the cylinder head housing.

33. The thrust stopper according to claim 32, wherein the plate assembly contains a mid-plane, wherein mid-plane is substantially perpendicular to the central axis of the camshaft, wherein the first orienting assembly and the second orienting assembly are located on the same side of the mid-plane.

34. The thrust stopper according to claim 32, wherein the second orienting assembly includes at least one projection, wherein the projection is received within a positioning recess within the rocker arm shaft.

35. The thrust stopper according to claim 32, wherein second orienting assembly includes a pair of ribs extending from a surface of the thrust stopper, wherein at least one of the pair of ribs is received within a positioning recess within the rocker arm shaft.

36. The thrust stopper according to claim 32, wherein the positioning recess is asymetrically positioned with respect to a central axis of the rocker arm shaft.

37. A thrust stopper for use in a cylinder head arrangement of an internal combustion engine, wherein the cylinder head arrangement includes a cylinder head housing, at least one camshaft located within the cylinder head housing, and at least one valve operating assembly located within the housing, the thrust stopper comprising:

a plate assembly;

first orienting assembly located on the plate assembly for orienting the at least one camshaft in a predetermined camshaft orientation within the cylinder head housing; and a second orienting assembly located on the plate assembly for orienting the at least one valve operating assembly in a predetermined orientation within the cylinder head housing.

38. The thrust stopper according to claim 37, wherein the first orienting assembly is located on one end of the plate assembly and the second orienting assembly is located on an opposite end of the plate assembly.

39. The thrust stopper according to claim 37, wherein the first orienting assembly includes a retaining section formed in the thrust stopper, wherein the retaining section is sized to be received within a groove formed in an outer surface of the at least camshaft.

40. The thrust stopper according to claim 38, wherein the second orienting assembly includes at least one projection, wherein one projection engages a portion of a free end of the at least one valve operating assembly.

41. The thrust stopper according to claim 38, wherein the second orienting assembly includes a pair of ribs extending from a surface of the thrust stopper, wherein at least one of the pair of ribs is received within a recess within an end of the valve operating assembly.

42. The thrust stopper according to claim 37, wherein the plate assembly is formed from a forged metal.

43. The cylinder head arrangement according to claim 2, further comprising:

a drive assembly for the camshaft, wherein the drive assembly is located adjacent one end of the camshaft and the groove is located on an opposite end of the camshaft spaced from the drive assembly.

* * * * *